United States Patent [19]

Burrage et al.

[11] 4,261,476

[45] Apr. 14, 1981

[54] JOINT FOR ENVELOPE OF VACUUM TYPE ELECTRICAL DEVICE

[75] Inventors: Lawrence M. Burrage, South Milwaukee; Hugo H. Wuerker, Racine, both of Wis.

[73] Assignee: McGraw-Edison Company, Rolling Meadows, Ill.

[21] Appl. No.: 747,560

[22] Filed: Dec. 6, 1976

Related U.S. Application Data

[63] Continuation of Ser. No. 551,658, Feb. 21, 1976, abandoned.

[51] Int. Cl.[2] ..... H01J 61/30; B65D 7/38

[52] U.S. Cl. ..... 220/2.1 R; 220/75

[58] Field of Search ..... 220/81 R, 81 A, 75, 220/76, 2.1 R, 2.1 A, 2.2, 2.3 R, 2.3 A

[56] References Cited

U.S. PATENT DOCUMENTS

| | | | |
|---|---|---|---|
| 503,108 | 8/1893 | Bates | 220/2.1 R |
| 1,545,036 | 7/1925 | Culhane, Jr. et al. | 220/81 R |
| 2,613,015 | 10/1952 | Keating | 220/81 R |
| 2,747,345 | 5/1956 | Plastino | 220/81 R |
| 3,411,542 | 11/1968 | Walsh et al. | 220/81 R |
| 3,632,009 | 1/1972 | Borromeo | 220/75 |
| 3,868,620 | 2/1975 | McBride, Jr. et al. | 338/28 |

FOREIGN PATENT DOCUMENTS

| | | | |
|---|---|---|---|
| 136690 | 12/1919 | United Kingdom | 220/81 R |

*Primary Examiner*—Joseph Man-Fu Moy

*Attorney, Agent, or Firm*—Jon C. Gealow; Ronald J. LaPorte; Roy A. Ekstrand

[57] ABSTRACT

A brazed slip joint is formed between housing portions, the portions forming an envelope to enclose an evacuated area. The ends of the housing portions overlap, one within the other, and each has a slight outward flare. The edge of the inner end makes line contact with the inner surface of the outer end. This arrangement defines an area between the overlapping ends which comes substantially to a point at that line contact and which is generally triangular in transverse cross section. That area is filled with a brazing alloy and a brazed joint is formed by exposure of the parts to the proper elevated temperature.

6 Claims, 4 Drawing Figures

Fig. 1
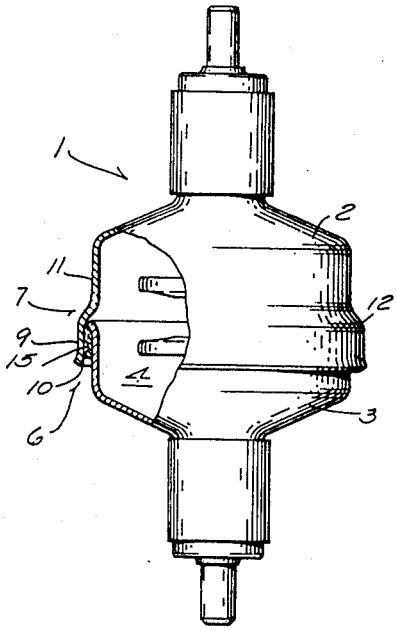
Fig. 2.
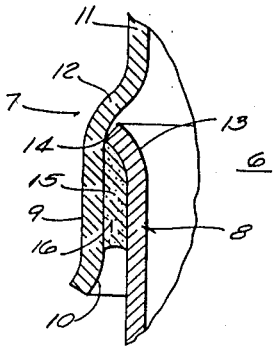
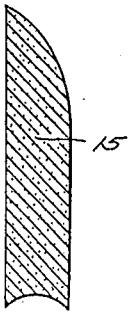
Fig. 4
Fig. 3
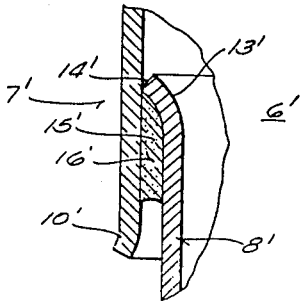

JOINT FOR ENVELOPE OF VACUUM TYPE ELECTRICAL DEVICE

This is a continuation of application Ser. No. 551,658 filed Feb. 21, 1976, now abandoned.

BACKGROUND OF THE INVENTION

This invention relates to electrical devices the operation of which takes place in a vacuum environment and, more particularly, to a structurally sound, vacuum sealed joint between the structural elements of the envelope surrounding that vacuum environment.

The types of electrical devices in which this invention may be used are varied, e.g. vacuum interrupters, vacuum switches, vacuum fuses, and the like. The element of commonality in these devices is that they achieve their operation in a vacuum environment.

Brazing and welding have been recognized as acceptable methods of making the necessary joints and connections in such devices, with brazing having been recognized as perhaps the most suitable because it is readily incorporated in the overall manufacturing process and provides both a mechanically sound and vacuum-tight seal.

This invention is concerned with providing an improved joint for use in such devices.

SUMMARY OF THE INVENTION

Among the general objects of this invention are to provide an improved slip joint between interfitting housing portions which define an envelope for an evacuated area in an electrical device; to provide a joint which readily accepts an amount of brazing alloy adequate to result in a mechanically sound and vacuum-tight joint; and to provide such a joint without requiring either complicated operations on those portions which define the joint or complicated processing steps to admit the brazing alloy into the joint.

For the achievement of these and other objects, this invention proposes a joint between mating portions of a vacuum area defining envelope wherein the edge of one portion makes line contact with the surface of the other. The portions overlap but are spaced apart other than at the line contact area to define a space into which a brazing alloy can be admitted. Preferably, this space is formed by a flare provided on the end of one portion, the end edge of the flared portion making the above mentioned line contact. The area so defined comes substantially to a point at the line contact and may be generally triangular in transverse cross section. It is further preferred that the end with which the flared end makes line contact be offset and the line contact be made within the offset portion.

Other objects and advantages will be pointed out in, or be apparent from, the specification and claims, as will obvious modifications of the embodiments shown in the drawings, in which:

FIG. 1 is a general illustration of a vacuum fuse embodying a joint formed in accordance with this invention;

FIG. 2 is an enlarged section view through a portion of the envelope and illustrating a preferred embodiment of the joint;

FIG. 3 is an enlarged section view of a portion of the envelope illustrating an alternative joint arrangement; and FIG. 4 is a section through a typical section of brazed alloy.

DESCRIPTION OF PREFERRED EMBODIMENTS

With paticular reference to FIG. 1 of the drawings, the improved joint of this invention is illustrated as embodied in a vacuum fuse 1. The actual interior structure of the vacuum fuse is not necessary to an understanding of this invention and therefore has not been illustrated and will not be described.

Bell shaped housing portions 2 and 3 are part of an outer housing, or envelope, which surrounds and defines an interior area 4 in which a vacuum is drawn so that the operation of the fuse, in a conventional manner, takes place in a vacuum environment. Overall, the elements of the vacuum fuse which make up the outer housing or envelope are all generally circular in radial cross section. Portions 2 and 3 are made of a suitable metallic material, such as copper-nickel, iron-nickel, copper, or stainless steel.

Portions 2 and 3 are separate members connected at a joint 6. The joint 6 must be mechanically sound to preserve the structural integrity of the outer envelope and also must provide a vacuum-tight seal to maintain the integrity of the vacuum in area 4. This invention is concerned with the construction of this joint.

A preferred joint will be described with reference being made to FIG. 2 as well as FIG. 1. Portions 2 and 3 include ends 7 and 8, end 8 being positioned radially inside of end 7. End 7 includes an offset portion 9, i.e. offset radially relative to the remainder 11 of end 7, so that end 7 includes an offsetting shoulder 12 which is disposed at an angle, preferably an oblique angle, to the portions 9 and 11 of the end of member 2.

End 8 of member 3 is provided with a portion 13 which flares radially outward relative to the basic axis of the vacuum fuse. End 7 also includes a radially flared end 10. Flared portion 13 terminates in an end edge 14 such that, with end 8 positioned inside of end 7 and overlapping a limited length of end 7, the end edge 14 engages the interior surface of end 7 and within offset portion 9. The remainder of end 8 and offset portion 9 of the members 2 and 3 are spaced apart relative to each other and define an area 16 therebetween. With this arrangement, end edge 14 makes line contact with the inner surface of end 7, specifically within offset portion 9, and with area 16 coming to a point at the line contact. This insures a good sealing contact between the overlapping ends of members 2 and 3 and, moreover, so defines area 16 that it effectively receives a suitable brazing alloy to achieve the mechanical connection between the two members and a vacuum-tight seal at the joint.

With the envelope members 2 and 3 arranged as just described, a brazing alloy can be positioned at area 16 so that when the fuse is subjected to a brazing temperature, e.g. the bake-out temperature for the overall fuse, the brazing alloy melts and is drawn, by capillary action, into area 16. The line contact insures a close engagement at that point so that the brazing alloy does not flow out of the area 16 at the line of contact between the ends 7 and 8. The brazing alloy bonds with the surfaces of ends 7 and 8 and provides a vacuum-tight seal and acceptable mechanical connection at the joint.

The resulting brazed alloy 15, is illustrated in FIG. 4 and can be seen that it takes on a shape which is substantially to a point and is generally triangular in transverse cross section. This is because the area 16 itself has that general shape in cross section due to the relative arrangement of ends 7 and 8 as a result of the flare provided on end 8. This triangular shape readily admits the brazing alloy during the brazing operation and in amounts sufficient to provide the mechanical connection and the vacuum-tight seal. In a preferred embodiment, the amount of overlap between end 8 and end 7 is generally in the neighborhood of $\frac{1}{4}$–$\frac{3}{8}$ inch and the distance between end 7 and end 8 at the open end of area 16 is generally approximately 0.010 inches. The 0.010 inch dimension, which forms the base of the triangle, is preferred for effective capillary action but the practice of this invention is not necessarily limited to these dimensions which are merely preferred relationships. Spacings at the open end greater than 0.010 inches may detract somewhat from the capillary action but still provide for movement of an adequate volume of brazing alloy into the area to provide an acceptable mechanical and vacuum-tight seal.

FIG. 3 illustrates an alternative joint 6'. In this embodiment, end 7' does not have the offset 9. However, end 8' retains flared portion 13' which terminates in end edge 14'. In this embodiment, end edge 14' engages the inner cylindrical surface of end 7', again establishing effective line contact. This arrangement also defines an area 16' having generally the same configuration as area 16, i.e. coming substantially to a point at the line contact and being generally triangular in transverse cross section, for effective entry of the brazing alloy into the joint to make a good seal along the line contact.

In practice, members 2 and 3 are formed by being drawn and rolled, or they may be spun, rolled, or drawn to whatever configuration is desired. The outward flares 13, 13' and 10, 10' are found to occur normally when the members 2 and 3 are drawn and/or rolled. By providing the offset portion 9 in one of the envelope forming members, both members can be made from the same tooling. Both are drawn on the same tooling and one is then rolled to provide the offset so that the members can overlap one within the other. In the embodiment of FIG. 3, members 2' and 3' have different diameters so that end 8' can fit within end 7', this requires two sets of tooling.

As to the brazing alloy, with sections 2 and 3 made preferably from Monel 404 or stainless steel 304, a copper silver alloy has provided adequate results.

Although this invention has been illustrated and described in connection with particular embodiments thereof, it will be apparent to those skilled in the art that various changes and modifications may be made therein without departing from the spirit of the invention or from the scope of the appended claims.

We claim:

1. In an electrical device wherein a sealed vacuum area is surrounded by an envelope and the envelope includes first and second portions joined together along adjacent ends thereof, the improvement wherein said joint is characterized in that an end of the first portion overlaps a limited length of an end of said second portion, the end of said first portion being inside of said end of said second portion and having a terminal flare positioned with an edge of said flare making line contact with said second portion end inwardly of the edge of said second portion end and throughout said overlap said first and second portions being otherwise spaced apart and defining an area therebetween which comes to a point at said line contact, said terminal flare being concaved when viewed from outside of said envelope, and a braze alloy filling said area to mechanically join said first and second portion and provide a vacuum-type seal at said joint.

2. The combination of claim 1 wherein said ends of said first and second portions are generally cylindrical and said end of said first portion is flared radially into engagement with said second portion.

3. The combination of claim 1 wherein said second portion includes a radially offset portion at its end and said first portion end fits into said offset with the end edge thereof engaged within said offset portion to define said line contact.

4. The combination of claim 3 wherein said area is generally triangular in cross section.

5. The combination of claim 1 wherein the end of said first portion is inside of the end of said second portion, said second portion includes an offset portion at its end and an offsetting shoulder disposed at an angle to said offset portion and the remainder of said second portion end, and said edge of said first portion is engaged with said second portion within said offset shoulder to define said line contact.

6. The combination of claim 5 wherein said area is generally triangular in cross ection.

* * * * *